US006276003B1

(12) United States Patent
Knapp

(10) Patent No.: US 6,276,003 B1
(45) Date of Patent: Aug. 21, 2001

(54) ADJUSTABLE SUPPORT FOR A SHOWER

(75) Inventor: Alfons Knapp, Biberach/Riss (DE)

(73) Assignee: Masco Corporation of Indiana, Taylor, MI (US)

( * ) Notice: Subject to any disclaimer, the term of this patent is extended or adjusted under 35 U.S.C. 154(b) by 0 days.

(21) Appl. No.: 09/555,830

(22) PCT Filed: Dec. 2, 1998

(86) PCT No.: PCT/US98/25484

§ 371 Date: Jun. 2, 2000

§ 102(e) Date: Jun. 2, 2000

(87) PCT Pub. No.: WO99/27832

PCT Pub. Date: Jun. 10, 1999

(30) Foreign Application Priority Data

Dec. 2, 1997 (IT) ..... TO97A1046

(51) Int. Cl.[7] ..... A47K 3/28
(52) U.S. Cl. ..... 4/567; 4/615
(58) Field of Search ..... 4/567, 568, 570, 4/601, 605, 615

(56) References Cited

U.S. PATENT DOCUMENTS 1,327,428 * 1/1920 Gregory ..... 4/567
2,017,396 * 10/1935 Brown ..... 4/615
5,339,469 8/1994 Gilles .
5,632,049 5/1997 Chen .
6,038,715 * 3/2000 Flieger et al. ..... 4/601

* cited by examiner

*Primary Examiner*—Robert M. Fetsuga
(74) *Attorney, Agent, or Firm*—Reising, Ethington, Barnes, Kisselle, Learman & McCulloch, PC

(57) ABSTRACT

An adjustable support for a shower, including a rod (10) installed in a substantially vertical position, which is supported near its midpoint by a support bracket (12) integrally formed with a mixing valve handle assembly (11). The rod (10) vertically extends in two branches (20, 30), an upper branch (20) and a lower branch (30) that mounts shower holders (19, 17) for retaining a hand held shower head (22). The holders (14, 17) are slidably mounted longitudinally along the rod and are equipped with a fastener for affixing them in a desired position. The rod (10) can be slidably adjusted longitudinally with respect to the support bracket (12) and, in this case, the support bracket for the rod is provided with a fastener (13) for affixing the rod (10) in place. The rod can furthermore be supported by a bracket (21) in proximity of its upper end.

11 Claims, 3 Drawing Sheets

ADJUSTABLE SUPPORT FOR A SHOWER

TECHNICAL FIELD

This invention relates to an adjustable support for a hand held shower, including a rod installed in a substantially vertical position, which allows a hand held shower supplied by a flexible hose to be mounted on the rod at an adjusted position.

BACKGROUND OF THE INVENTION

Two basic types of shower heads are found in residential indoor bath and shower stalls. One is referred to as a fixed showerhead that is screwed onto the end of a rigid pipe at the top end of a shower riser. The second is usually called a hand held shower or manual shower which is attached to the end of a flexible hose. It usually has an elongated handle for manual grasping. While the hand held shower is popular because of the flexibility and manual grasping and freedom of position of the shower, there are many times when a person wants the hands free operation that is the feature of the fixed shower head. In order to have hands free for operation of the hand held shower, adjustable supports are mounted on the shower wall to mount the hand held shower.

In known adjustable supports, a rod is usually attached to a wall by means of brackets situated at the rod's two opposite ends. The rod usually has its bottom end close to the level of the flow adjustment handles and the rod extends upwardly therefrom. A single mounting bracket is slidably mounted along the rod and has a set screw or set knob that allows the securement of the mounting bracket. The mounting bracket has a clip or pin that mounts the hand held shower. Also known is an adjustable support for a shower where the rod is threaded into the body of a mixing valve assembly for vertical adjustment.

The valve assembly has a securement device for affixing the rod in a desired position. A shower head supplied through a flexible hose emanating from the mixer valve is mounted in a removable manner at the upper end of the rod. In this case, the adjustment of the height of the shower head is accomplished by running the rod in the body of the mixer. All of these adjustable supports for a hand-held shower make it possible to adjust the height at which the hand held shower is installed but only at relatively high levels close to the stature of a person. Naturally, there are cases where one wishes that a shower releases its jet at a lower level, for example, for washing confined to the feet or other lower parts of the body; or during a bath, one wishes to wash and rinse his/her hair. In these cases, the shower must be held manually during the washing operations with subsequent diminished comfort.

What is needed is an improved support for a hand held shower head that provides increased choice and range of position for hands free operation.

SUMMARY OF THE INVENTION

In accordance with one aspect of the invention, an adjustable shower support includes a support bracket mountable on a wall that mounts a substantially vertically oriented rod between its upper and lower ends. The rod has an upper shower holder and a lower shower holder mounted to the vertically oriented rod respectively above and below said support bracket. At least one of the shower holders is slidably mounted along the rod and equipped with a fastener for releasably affixing the slidably mounted shower holder in a desired position along the vertically oriented rod. Each shower holder is constructed to releasably hold a hand held shower that is connected to a flexible hose that is operably connectable to a water supply.

Preferably, the support bracket is mounted on the wall at approximately the same height as a wall mounted valve device that controls the water supply to the flexible hose and hand held shower. In one embodiment, the support bracket is integrally part of the valve device. The valve device may be a mixing valve, thermostatic mixing valve or a simple faucet tap.

It is desired that the rod is slidably mounted with respect to the support bracket and the support bracket has a fastener for releasably and longitudinally affixing the rod in a desired vertical height. In this embodiment, one of shower holders is slidably mounted along the rod and one of the shower holders is permanently affixed to the rod. The shower holder that is slidably mounted on the rod is provided with a fastener to releasably affix the slidably mounted shower holder at a desired position along the rod. Preferably, it is the upper shower holder that is slidably mounted along said rod and the lower shower holder that is permanently affixed to a lower end of the rod below the support bracket.

Alternatively, the rod is non-adjustably affixed to the support bracket. In this embodiment, both shower holders are slidably mounted along the rod and equipped with a fastener for releasably vertically affixing said slidably mounted shower holder in a desired position along the rod.

In one embodiment, a second support bracket is mountable to the wall and slidably mounts the rod at an upper section thereof.

In this fashion the shower holder, intended for receiving and retaining a base of a hand held shower, can be shifted independently along the direction of the rod and can be affixed at desired heights. The one that is on the upper branch of the rod is suitable for receiving the hand held shower when the user desires to spray the body from a traditional high shower position: The holder on the lower branch of the rod is suitable for receiving and retaining the hand held shower when the user wishes to spray the lower parts of the body without bathing the upper parts or wishes to rinse hair when taking a bath.

BRIEF DESCRIPTION OF THE DRAWINGS

Reference is now made to the accompanying drawings in which.

DETAILED DESCRIPTION OF THE PREFERRED EMBODIMENT

Figure 1:
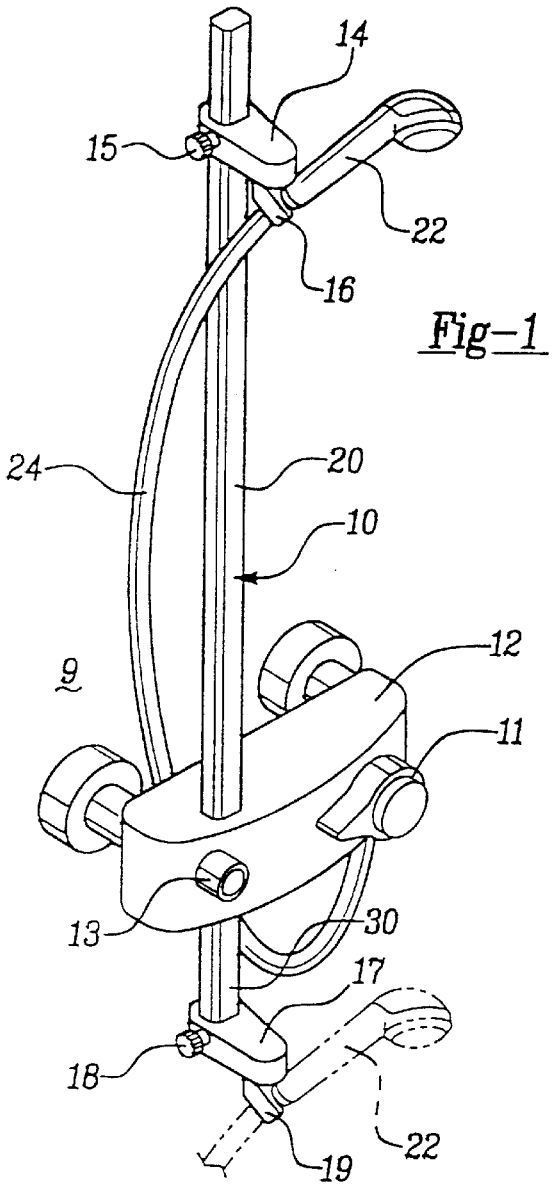
FIG. 1 is a perspective view of an adjustable support for a hand held shower.

FIG. 1 illustrates an adjustable support for a shower, which comprises a vertical rod 10, which is supported by a supporting bracket 12, which in this case also incorporates a mixing valve with operating handle assembly 11 attached to a wall. As such, the valve 11 and suppport bracket 12 are mounted at the same height. A rod 10 is mounted in a slidable fashion through supporting bracket 12. The bracket 12 has a fastener screw 13 for fixing the rod 10 in the desired position. Other fastener mechanisms, for example, a screw knob, a push button, a friction device, detent, or some other suitable device can also be used in place of fastener screw 13. Rod 10 extends in two branches, one branch 20 extended above the supporting bracket 12 and the other branch 30 extending below it. On each of these two branches 20, 30, of rod 10, there is mounted a respective shower holder, 14 and 17. Each holder adjustably slides longitudinally on rod 10. A fastener screw 15 and 18, operates in respective shower holder 14 and 17, for releasably affixing the respective shower holder in a desired position. In this case, likewise, other fasteners such as a screw know, a push button, a friction device, detent, or some other suitable device can substitute for screws 15 and 18.

Furthermore, each of the holders 14 and 17 has a holder mechanism respectively 16 and 19, for example, in the form of a fork suitable for releasably gripping a hand held shower 22, which is supplied from a flexible hose 24 in this case coming from mixer 12. The holders 16 and 19 may alternatively take the form an upright peg which is received in an aperture at the base of the hand held shower 22. Therefore, hand held shower 22 can be secured to upper holder 14 in order to shower the entire body of the user from above but it can also be affixed to the lower holder 17 as shown in phantom. This lower position is amenable to showering a lower part of the body without bathing higher parts of the body itself or rinsing a person's hair after shampooing when the user is taking a bath. This lower operation can be carried out without the user holding the shower in the hand and thus freeing up both hands.

The height at which slidable holders 14 and 17 (and from which, therefore, the shower 22 releases its jet) can be adjusted is independent for the two holders 14 and 17. Each one can slide along rod 10 and be affixed in a desired position. Furthermore, rod 10 can slide in the supporting bracket 12 to have it placed in a more suitable position for vertically positioning holders 14 and 17.

Figure 2:
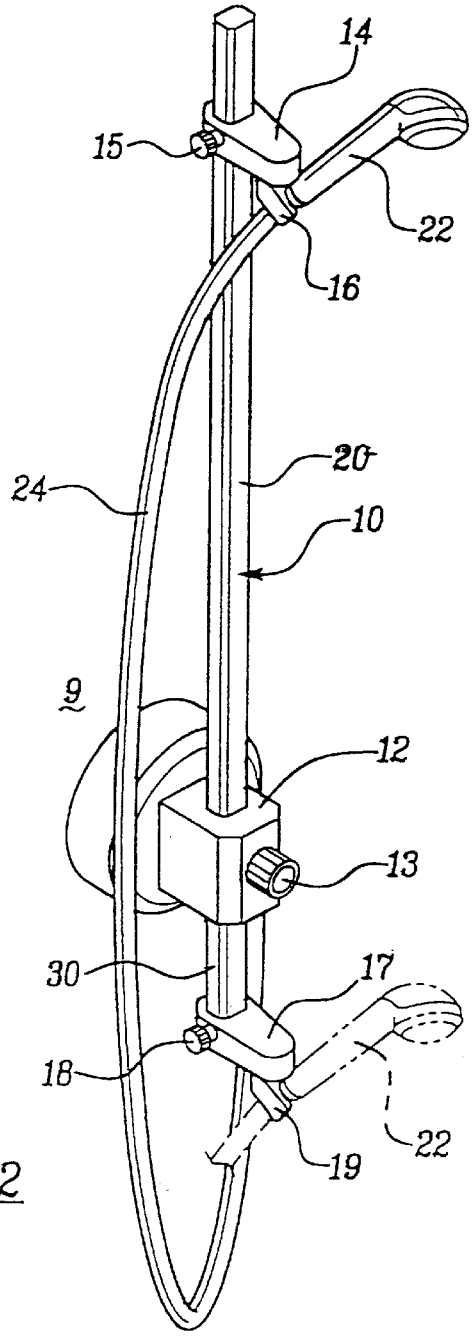
FIG. 2 is a perspective view similar to FIG. 1 illustrating a second embodiment.

FIG. 2 shows another embodiment, which differs from the one in FIG. 1, only by virtue of the fact that supporting bracket 2 for rod 1 does not incorporate a mixer valve but a simple faucet tap applied to a wall and from which emanates flexible hose 24 which supplies shower 22. Regarding this and other embodiments, everything that has been said with regard to the embodiment according to FIG. 1 also applies and reference to like parts are numbered by identical numerals.

Figure 3:
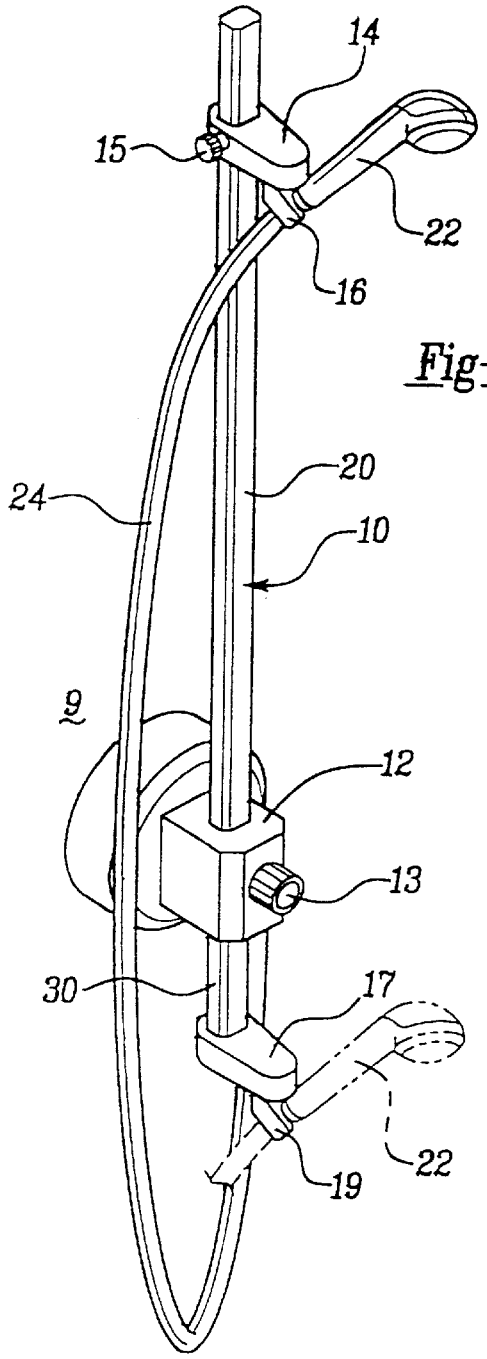
FIG. 3 is an illustrated variation of the embodiment shown in FIG. 2 where the lower shower holder is non-adjustably affixed to the rod.
Figure 4:
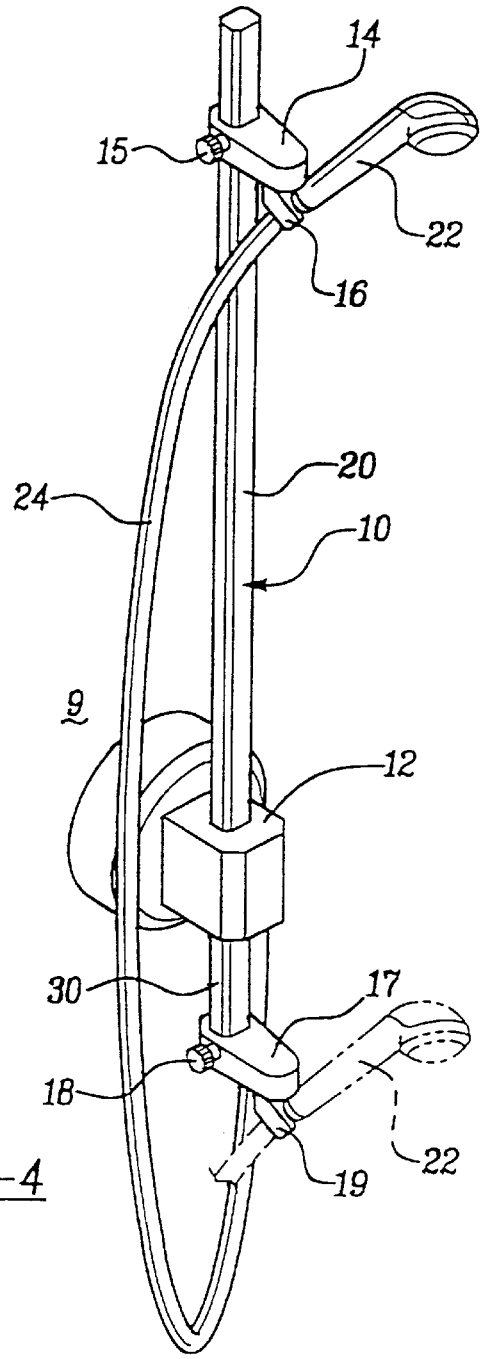
FIG. 4 illustrates another variation of the embodiment shown in FIG. 2 where the shower rod is non-adjustably affixed to the support bracket.

As illustrated in FIG. 4, support bracket 12 may be non-adjustably affixed with rod 10. In this variation the fastener screw 13 can then be omitted or need not be available to the user. On the other hand, as illustrated in FIG. 3, if the position of rod 10 is adjustable, one may omit the adjustment screw 18 on the lower holder 17 intended to receive the hand held shower 22. The holder 17 is alternately fixed at the lower end of the rod 10. The holder 17 can no longer slide along rod 10 but slides with rod 10. Nevertheless, the positions of the two holders 14 and 17, intended to receive a hand held shower 22, remain independently adjustable, the lower one 17 is adjustable with the adjusted position of rod 10 and the upper one 14 is adjusted along the rod 10.

Figure 5:
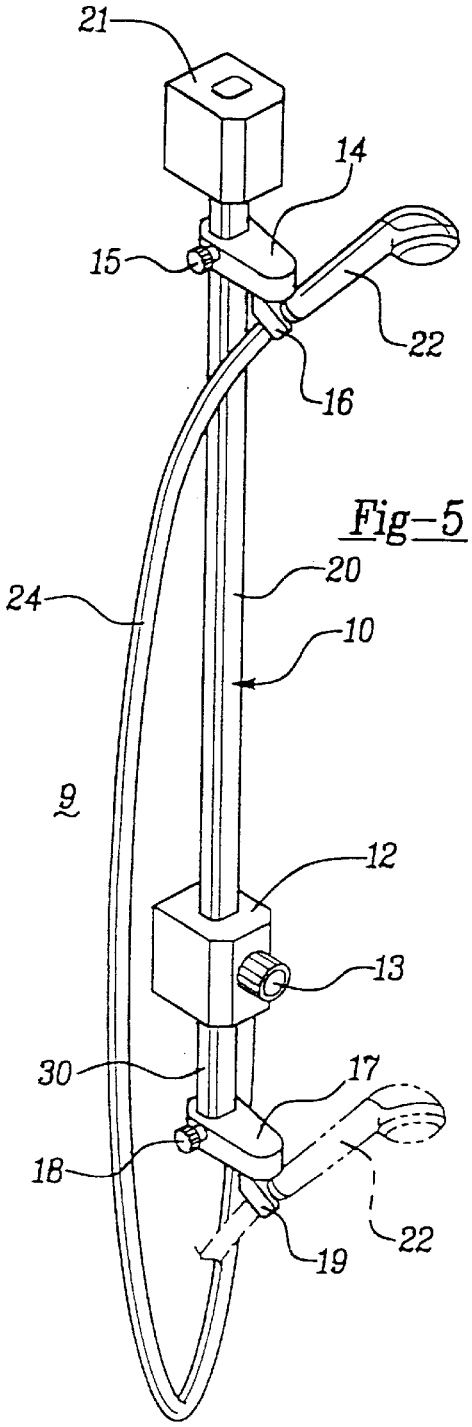
FIG. 5 is a perspective view similar to FIG. 2 illustrating a third embodiment.

FIG. 5 shows another embodiment that differs from the one according to FIG. 2 only by virtue of the fact that rod 10 is supported, in addition to supporting bracket 12, in proximity to its upper end, by a bracket 21 applied to the wall 9 itself. Bracket 12 incorporates a tap from which starts flexible hose 24 that supplies shower 22. This embodiment makes it possible to render rod 10 more stable and possibly to lighten its construction. Everything that has been said with regard to the embodiments according to FIGS. 1 and 2 applies to this embodiment. In particular, if rod 10 is installed so that it can run in supporting bracket 12, it will also be capable of slidable adjustment with respect to the upper bracket 21. Therefore, the bracket 21 slidably supports the rod at its upper end.

Figure 6:
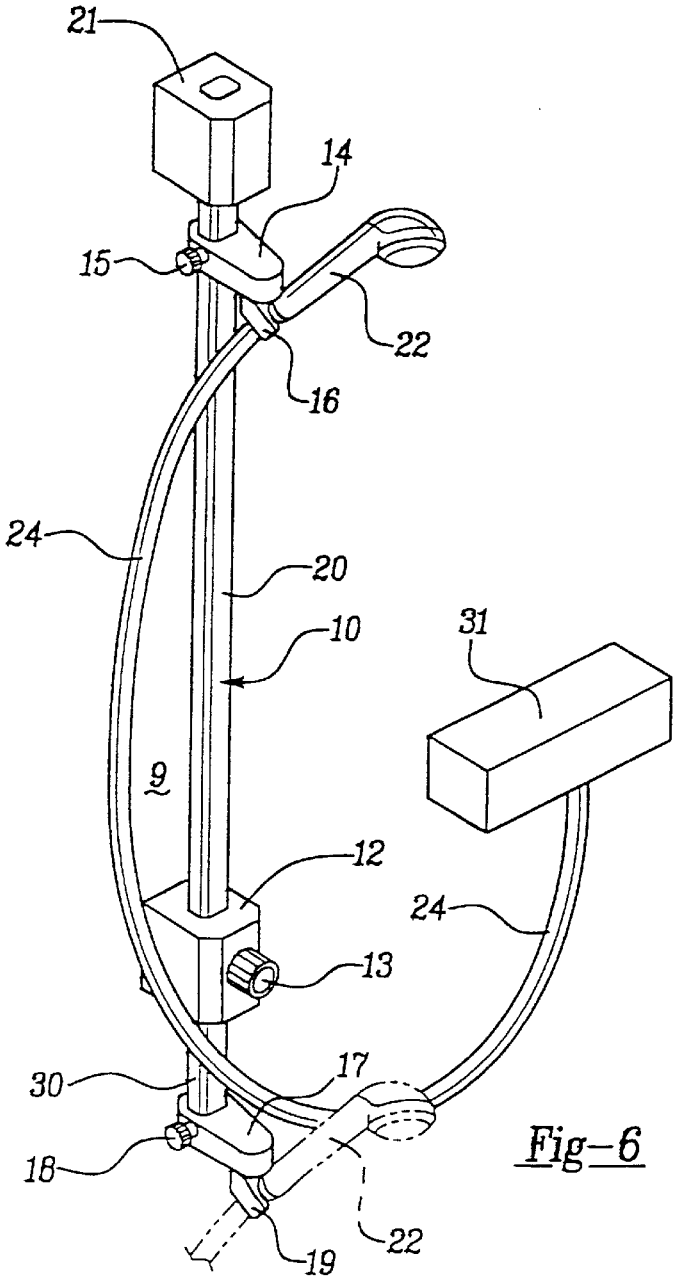
FIG. 6 is a perspective view similar to FIG. 1 illustrating a fourth embodiment.

In turn, FIG. 6 shows an embodiment that differs from the one according to FIG. 5 only by the fact that supporting bracket 12 does not incorporate any hydraulic tap, valve, or other hydraulic fixture. The hand held shower 22 and flexible hose 24 are operably connected to a separate valve apparatus 31, which can be a mixing valve, thermostatic mixing valve or a simple faucet tap.

In the above described fashion, the invention allows the user to mount the shower in a low position useful for spraying the lower parts of the body without bathing the upper parts or for rinsing the user's head and hair while taking a bath in addition to the high position to use the shower in the traditional fashion. Furthermore, for each of the two shower positions, one can adjust the height of the hand held shower so that the user may adjust the shower to the user's stature and preferences.

Other variations are foreseen without departing from the spirit and scope of the invention as defined in the appended claims.

I claim:

1. An adjustable shower support characterized by:

a support bracket mountable on a wall;

said support bracket mounting a substantially vertically oriented rod between its upper and lower ends;

said rod has an upper shower holder and a lower shower holder mounted to the vertically oriented rod respectively above and below said support bracket;

at least one of the shower holders being slidably mounted along said rod and equipped with a fastener for releasably affixing said slidably mounted shower holder in a desired position along the rod;

each shower holder is constructed to releasably retain a hand held shower that is connected to a flexible hose that is in turn operably connectable to a water supply.

2. An adjustable shower support as defined in claims 1 further characterized by:

said support bracket being mounted on the wall at approximately the same height as a wall mounted valve device that controls the water supply to the flexible hose and hand held shower.

3. An adjustable shower support as defined in claim 2 further characterized by:

said support bracket being integrally part of the valve device.

4. An adjustable shower support as defined in claim 3 further characterized by:

said rod is slidably mounted with respect to said support bracket and said support bracket has a fastener for releasably and longitudinally affixing said rod in a desired vertical height.

5. An adjustable shower support as defined in claim 4 further characterized by:

a second support bracket mountable to said wall slidably supporting said rod at an upper section thereof.

6. An adjustable shower support as defined in claim 3 further characterized by:

a second support bracket mountable to said wall and supporting an upper section of said rod.

7. An adjustable shower support as defined in claim 3 further characterized by:

one of shower holders being slidably mounted along the rod and one of the shower holders being permanently affixed to said rod.

8. An adjustable shower support as defined in claim 7 further characterized by:

said upper shower holder being slidably mounted along said rod and said lower shower holder being permanently affixed to said rod below said support bracket.

9. An adjustable shower support as defined in claim 2 further characterized by:

the rod is non-adjustably affixed to the support bracket.

10. An adjustable shower support as defined in claim 9 further characterized by:

both shower holders are slidably mounted along the rod and equipped with a fastener for releasably vertically affixing said slidably mounted shower holder in a desired position along the rod.

11. An adjustable shower support as defined in claim 1 further characterized by:

the rod is non-adjustably affixed to the support bracket.

* * * * *